US005934172A

United States Patent [19]

Terauchi

[11] Patent Number: 5,934,172

[45] Date of Patent: Aug. 10, 1999

[54] SWASH PLATE TYPE COMPRESSOR HAVING AN IMPROVED PISTON ROTATION REGULATING-STRUCTURE

[75] Inventor: Kiyoshi Terauchi, Isesaki, Japan

[73] Assignee: Sanden Corporation, Gunma, Japan

[21] Appl. No.: 08/831,976

[22] Filed: Apr. 2, 1997

[30] Foreign Application Priority Data

Apr. 3, 1996 [JP] Japan ..... 8-81348

[51] Int. Cl.[6] ..... F16J 15/18

[52] U.S. Cl. ..... 92/165 PR; 92/71; 417/269; 74/60

[58] Field of Search ..... 92/71, 12.2, 165 R, 92/165 PR; 417/269; 91/499; 74/60

[56] References Cited

U.S. PATENT DOCUMENTS

| | | | |
|---|---|---|---|
| 3,939,717 | 2/1976 | Teisen | 74/60 |
| 4,364,306 | 12/1982 | Hattori et al. | 92/71 |
| 4,789,311 | 12/1988 | Ikeda et al. | 92/71 |
| 5,140,903 | 8/1992 | Terauchi | 92/12.7 |
| 5,380,166 | 1/1995 | Terauchi | 417/269 |
| 5,382,139 | 1/1995 | Kawaguchi et al. . | |
| 5,490,767 | 2/1996 | Kanou et al. . | |
| 5,615,599 | 4/1997 | Terauchi | 92/165 R |
| 5,720,215 | 2/1998 | Asplund et al. | 92/165 R |

FOREIGN PATENT DOCUMENTS

| | | |
|---|---|---|
| 0587023A1 | 3/1994 | European Pat. Off. . |
| 0740076A2 | 10/1996 | European Pat. Off. . |
| 06346844 | 12/1994 | Japan . |
| 08177733 | 11/1996 | Japan . |

*Primary Examiner*—Thomas E. Denion
*Attorney, Agent, or Firm*—Baker & Botts, L.L.P.

[57] ABSTRACT

In a swash plate type compressor in which a piston (60) is reciprocated in accordance with a rotary motion of a swash plate and is located within a housing (2) having an inner periphery (2*a*), the piston is formed with first and second rotation-regulating surfaces (62*a*, 63*a*) which face the inner periphery and have centers of curvature at positions different from one another. The first and second rotation-regulating surfaces are angularly offset from one another. It is preferable that the curvature of each of the first and second rotation-regulating surfaces is equal to or smaller than that of the inner periphery of the housing.

14 Claims, 3 Drawing Sheets

SWASH PLATE TYPE COMPRESSOR HAVING AN IMPROVED PISTON ROTATION REGULATING-STRUCTURE

BACKGROUND OF THE INVENTION

The present invention relates to a swash plate type compressor in which a rotary motion of a swash plate is converted into reciprocating motions of pistons via shoes interposed between the swash plate and the pistons, and more specifically, to a structure for regulating rotation of each piston so as to prevent contact or engagement between the swash plate and each piston in the swash plate type compressor.

In a swash plate type compressor of this type, there has been a problem that the pistons are rotated about their respective axes so that the pistons contact or engage with the circumference of the swash plate to cause abrasion of the associated members, noise and the like.

For solving the foregoing problem, Japanese First (unexamined) Patent Publication No. 6-346844 discloses a piston rotation-regulating structure in the swash plate type compressor. In the disclosed structure, rotation of each piston is regulated through sliding engagement between one or more rotation-regulating convex curved surfaces provided on the piston and the inner periphery of a compressor housing.

However, in this publication, even when the plurality of rotation-regulating convex curved surfaces are provided, the centers of curvature of them in a circumferential direction of the piston are located at the same position. Thus, it is equivalent to using only one rotation-regulating convex curved surface for regulating rotation of the piston. Further, since the curvature of the rotation-regulating convex curved surface is set greater than that of the inner periphery of the compressor housing, a line contact rather than a surface contact is formed therebetween to raise a problem in view of abrasion resistance.

SUMMARY OF THE INVENTION

It is therefore an object of the present invention to provide a swash plate type compressor which has an improved piston rotation-regulating structure.

It is another object of this invention to provide an improved piston rotation-regulating structure for a swash plate type compressor.

Other objects of this invention will become clear as the description proceeds.

According to an aspect of the present invention, there is provided a swash plate type compressor comprising a housing having a first axis and an inner periphery of zeroth curvature around the first axis, a swash plate rotatable around the first axis, and a piston operatively coupled to the swash plate within the housing and reciprocating in accordance with a rotary motion of the swash plate along a second axis parallel to the first axis. In the swash plate type compressor, the piston has a first and a second rotation-regulating surface which are angularly offset from one another around the second axis and face the inner periphery. The first rotation-regulating surface has a center of first curvature at a first position. The second rotation-regulating surface has a center of second curvature at a second position different from the first position.

According to another aspect of the present invention, in a swash plate type compressor having a housing in which a rotary motion of a swash plate is converted into a reciprocating motion of a piston via a shoe interposed between each of opposite sides of the swash plate and a given portion of the piston, a piston rotation-regulating structure comprises a plurality of rotation-regulating convex curved surfaces provided on the piston so as to face an inner periphery of the housing for limiting a rotation range of the piston to prevent engagement between the piston and a circumference of the swash plate, wherein the centers of curvature of the rotation-regulating convex curved surfaces in a circumferential direction of the piston are located at different positions from each other.

DESCRIPTION OF THE PREFERRED EMBODIMENTS

Figure 1:
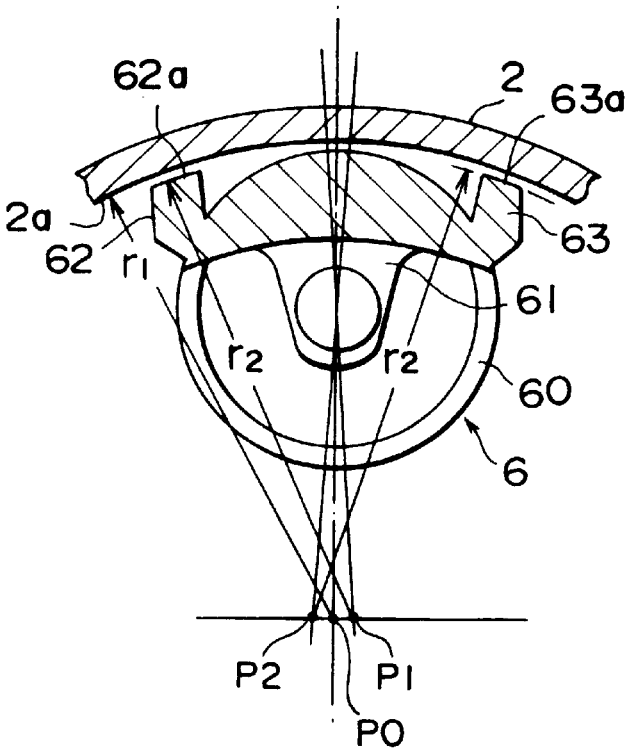
FIG. 1 is a cross-sectional view showing a piston rotation-regulating structure in a variable displacement swash plate type compressor according to a first embodiment of the present invention.
Figure 2:
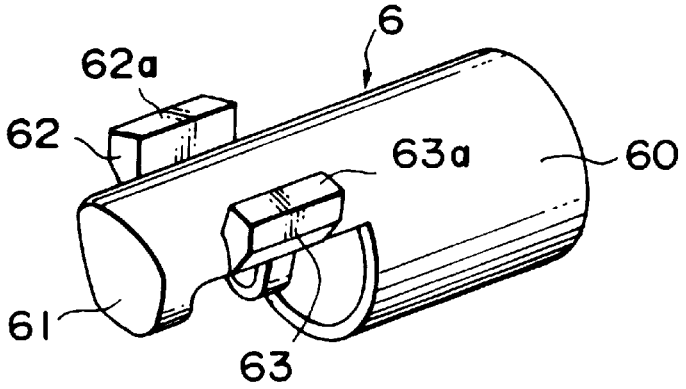
FIG. 2 is a perspective view showing the main part of the piston rotation-regulating structure shown in FIG. 1.
Figure 3:
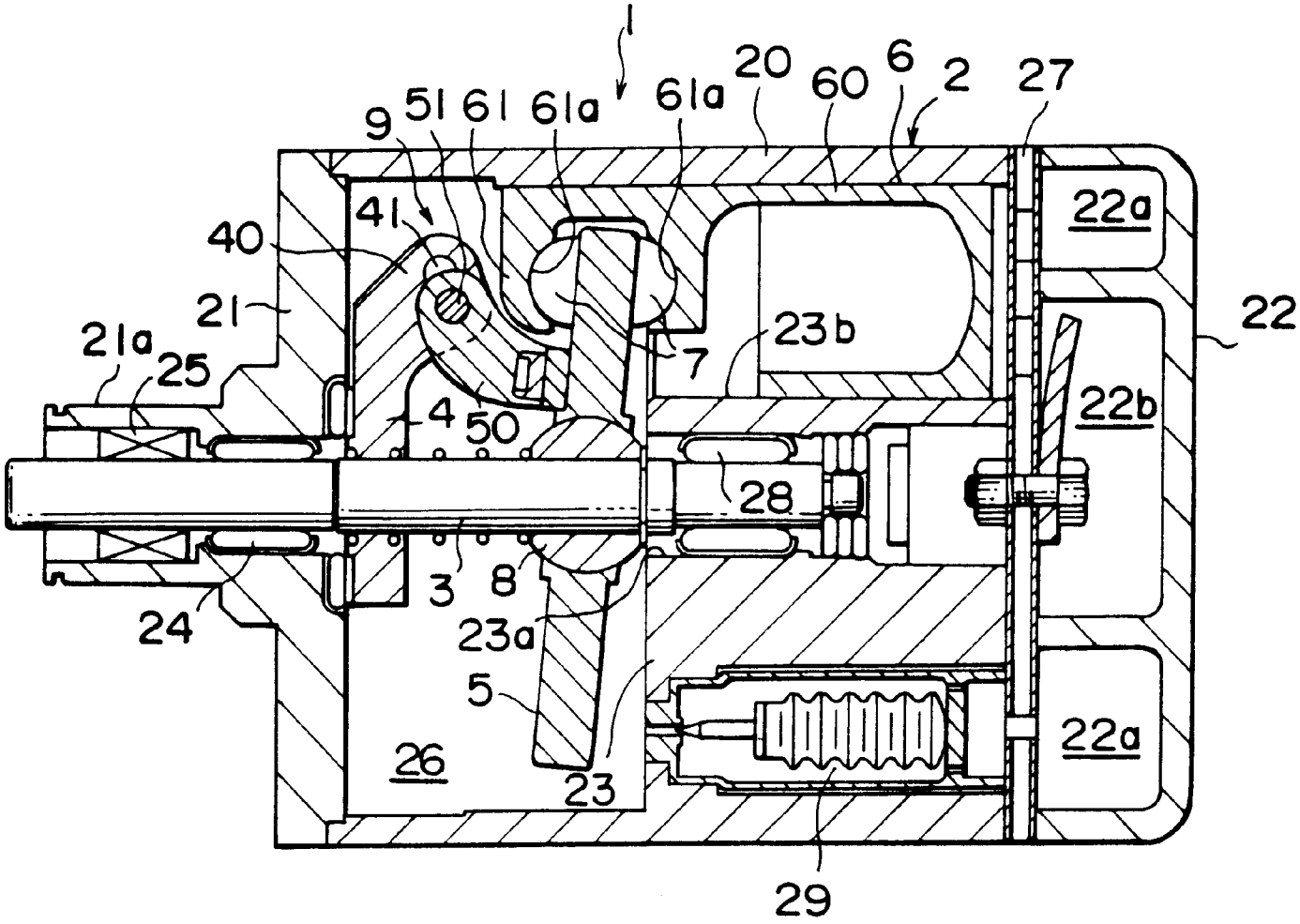
FIG. 3 is a longitudinal-sectional view showing a variable displacement swash plate type compressor having the piston rotation-regulating structure shown in FIG. 1.

Referring to FIGS. 1–3, description will be made as regards a swash plate type compressor according to a first embodiment of this invention. In the manner which will become clear from the following description, the swash plate type compressor has an improved piston rotation-regulating structure. In the following description, the left side of FIG. 3 will represent the front side of the compressor 1 while the right side thereof will represent the rear side of the compressor 1, which is only for the sake of convenience of description and is not intended to limit the invention in any way.

In the figures, the swash plate type compressor is designated by a reference numeral 1. In the manner which will presently be described, the compressor 1 includes a housing 2, a main shaft 3, a rotor 4, a swash plate 5, pistons 6, and shoes 7.

The housing 2 includes a housing body 20, a front housing 21 and a cylinder head 22. The housing body 20 is essentially cup-shaped with an open front end and has a first axis and an inner periphery 2*a* of zeroth curvature around the first axis. A cylinder block 23 is moulded or formed integral with the housing body 20 at the rear side thereof. The front housing 21 is essentially funnel-shaped with a tubular portion 21*a* in which a needle bearing 24 and a shaft seal unit 25 are disposed. The front housing 21 is attached to the housing body 20 so as to close the foregoing open front end of the housing body 20. Accordingly, a crank chamber 26 is defined in the housing body 20 between the front housing 21 and the cylinder block 23. The cylinder head 22 is attached to the housing body 20, via a valve plate 27 interposed therebetween, at the rear end of the housing body 20. The cylinder head 22 is formed with a peripherally positioned annular suction chamber 22*a* and a centrally positioned discharge chamber 22*b*. The cylinder block 23 is formed at the center thereof with a center bore 23*a* in which a needle bearing 28 is disposed. The cylinder block 23 is further formed with cylinder bores 23*b* arranged at regular intervals circumferentially so as to surround the center bore 23*a*. Further, the cylinder block 23 is provided therein with a control valve mechanism 29.

The main shaft 3 is rotatably supported on the first axis by the front housing 21 at its portion near the front end thereof via the needle bearing 24 arranged in the tubular portion 21*a* and further rotatably supported by the cylinder block 23 at its rear end via the needle bearing 28 arranged in the center bore 23*a* of the cylinder block 23. The front end of the main shaft 3 extends to the exterior from the housing 2 through the tubular portion 21*a*.

The rotor 4 is fixedly mounted on the main shaft 3. The rotor 4 has a hinge portion 40 which is formed with an arc-shaped elongate slot 41.

The swash plate 5 is essentially disk-shaped and has a hinge portion 50. The swash plate 5 is slidably mounted on a spherical sleeve 8 which is mounted on the main shaft 3 so as to be movable in an axial direction thereof. A pin 51 is secured at the hinge portion 50 of the swash plate 5. The pin 51 is movably received within the elongate slot 41 of the hinge portion 40 of the rotor 4 so that the swash plate 5 is coupled to the rotor 4. By means of a hinge mechanism 9 composed of the hinge portions 40, 50 and the pin 51, and the sleeve 8, the swash plate 5 rotates together with the main shaft 3 and is variable in angle of inclination relative to the main shaft 3.

Each piston 6 includes a piston portion 60 and a neck portion 61. The piston portion 60 is slidably received within the corresponding cylinder bore 23*b* of the cylinder block 23. The neck portion 61 continuously extends from the front end of the piston portion 60. The neck portion 61 is formed with a pair of hemispherical concave portions 61*a* facing each other. The concave portions 61*a* slidably receive therein the shoes 7 so that the swash plate 5 is slidably held between the shoes 7 at the neck portion 61 of each piston 6. With this arrangement, each piston 6 is coupled to the swash plate 5. When the swash plate 5 rotates, a rotary motion of the swash plate 5 is converted into reciprocating motions of the pistons 6 via the shoes 7 so that the pistons 6 reciprocate within their respective cylinder bores 23*b* along a second axis parallel to the first axis, thereby introducing, compressing and discharging the working fluid.

At the back of the neck portion 61 of each piston 6 confronting the inner periphery 2*a* of the housing 2, first and second rotation-regulating portions 62 and 63 are provided. The first and second rotation-regulating portions 62 and 63 project towards the inner periphery 2*a* of the housing 2 from positions which are adjacent to left and right edges of the neck portion 16 in FIG. 1. The first and second portions 62 and 63 have first and second rotation-regulating convex curved surfaces 62*a* and 63*a*, respectively, which are angularly offset from one another around the second axis and face the inner periphery 2*a* of the housing 2.

The first and second convex surfaces 62*a* and 63*a* are provided for limiting a rotation range of the piston 6 so as to prevent engagement between the neck portion 61 of the piston 6 and the circumference of the swash plate 5. As shown in FIG. 1, the center of curvature of the first convex surface 62*a* in the circumferential direction of the piston 6 is located at a first position P1 while that of the second convex surface 63*a* is located at a second position P2. Thus, the centers (P1 and P2) of the first and second convex surfaces 62*a* and 63*a* are located at different positions from each other and further deviated or dislocated from the center (P0) of curvature of the inner periphery 2*a* of the housing 2. In other words, each of the first and the second positions P1 and P2 is offset from the first axis. Furthermore, radii of curvature of the first and second convex surfaces 62*a* and 63*a* are each set to r2 which is equal to or greater than r1, i.e. a radius of curvature of the inner periphery 2*a* of the housing 2. Specifically, the curvatures of the first and second convex surfaces 62*a* and 63*a* are set equal to each other while equal to or smaller than the curvature of the inner periphery 2*a* of the housing 2.

It should be noted here that each of the first and second axes extends along a predetermined plane, that the first convex curved surface 62*a* and the second position P2 is located at one side of the predetermined plane, and that the second convex curved surface 63*a* and the first position P1 is located at another side of the predetermined plane. In this connection, the first axis or the center (P0) is between the first and second positions P1 and P2. A distance between the first axis and the first position P1 is equal to that between the first axis and the second position P2.

Figure 4:
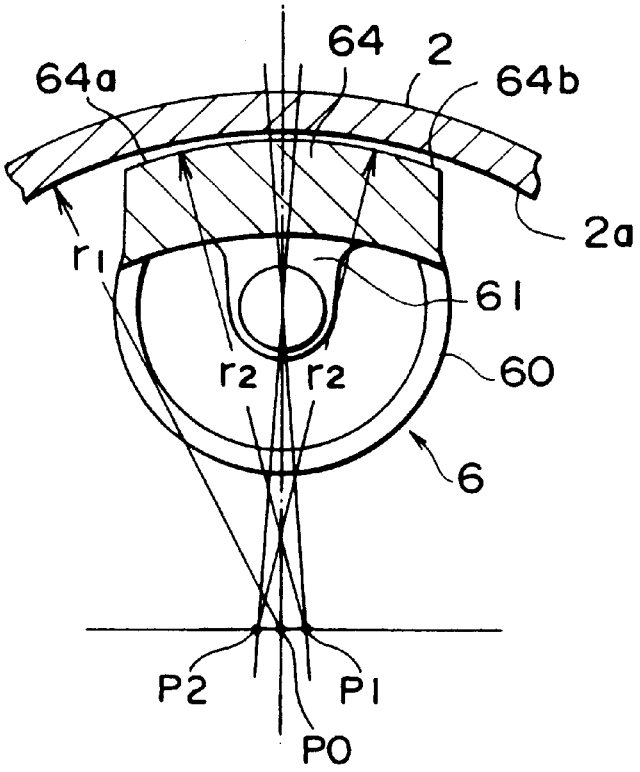
FIG. 4 is a cross-sectional view showing a piston rotation-regulating structure in a variable displacement swash plate type compressor according to a second embodiment of the present invention.
Figure 5:
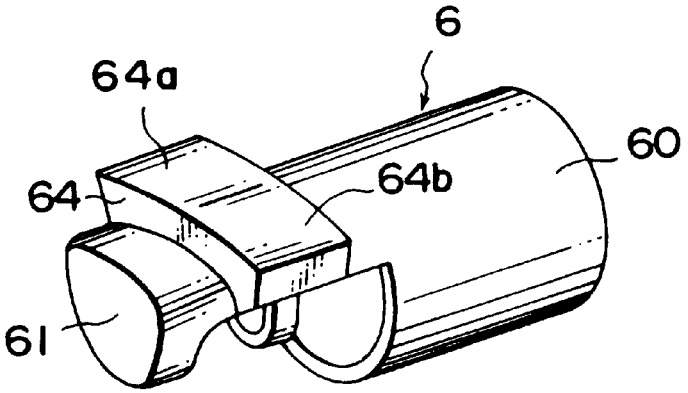
FIG. 5 is a perspective view showing the main part of the piston rotation-regulating structure shown in FIG. 4.

Next referring to FIGS. 4 and 5, the description will be made as regards a swash plate type compressor according to a second embodiment of the present invention. The swash plate type compressor comprises similar parts designated by like reference numerals.

In the compressor 1, one rotation-regulating portion 64 is provided at the back of the neck portion 61 of each piston 6 instead of the first and second rotation-regulating portions 62 and 63 in the foregoing first preferred embodiment. On the other hand, the rotation-regulating portion 64 is formed with first and second rotation-regulating convex curved surfaces 64*a* and 64*b*. The first and second convex surfaces 64*a* and 64*b* are formed similar to the first and second convex surfaces 62*a* and 63*a* in the foregoing first preferred embodiment. Specifically, as shown in FIG. 4, the center of curvature of the first convex surface 64*a* in the circumferential direction of the piston 6 is located at a position P1 while that of the second convex surface 64*b* is located at a position P2. Thus, the centers (P1 and P2) of the first and second convex surfaces 64*a* and 64*b* are located at different positions from each other and further deviated or dislocated from the center (P0) of curvature of the inner periphery 2*a* of the housing 2. A distance between the centers P0 and P1 is equal to that between the centers P0 and P2. Furthermore, radii of curvature of the first and second convex surfaces 64*a* and 64*b* are each set to r2 which is equal to or greater than r1, i.e. a radius of curvature of the inner periphery 2*a* of the housing 2. Specifically, the curvatures of the first and second convex surfaces 64*a* and 64*b* are set equal to each other while equal to or smaller than the curvature of the inner periphery 2*a* of the housing 2. It should be noted that the first rotation-regulating convex curved surface 64*a* is located at one side of the above-mentioned predetermined plane and that the second rotation-regulating convex curved surface 64*b* is located at another side of the predetermined plane.

As described above, according to the foregoing first and second preferred embodiments, the neck portion of each piston and the circumference of the swash plate can be prevented from engaging with each other. Further, the plurality of rotation-regulating convex curved surfaces are provided for each piston with their centers of curvature being located at different positions from each other. Thus, the curvature of each rotation-regulating convex curved surface can be set equal to or smaller than that of the inner periphery of the housing. This makes it possible to bring the contact between the rotation-regulating convex curved surface and the inner periphery of the housing more to the surface contact as compared with the foregoing prior art. As a result, the abrasion resistance at the engaging portion between the rotation-regulating convex curved surface and the inner periphery of the housing can be improved.

While this invention has thus far been described in conjunction with the several preferred embodiments, it will readily be understood for those skilled in the art to put this invention into practice in various other manners. For example, this invention is applicable to a swash plate type compressor of another type in which the swash plate is fixed to the main shaft to have a fixed angle relative to the first axis.

What is claimed is:

1. A swash plate type compressor comprising:

a housing having a first axis and an inner periphery of zeroth curvature around said first axis;

a swash plate rotatable around said first axis; and a piston operatively coupled to said swash plate within said housing and reciprocating in accordance with a rotary motion of said swash plate along a second axis parallel to said first axis, said piston having a first and a second rotation-regulating surface which are angularly offset from one another around said second axis and face said inner periphery, said first rotation-regulating surface having a center of first curvature at a first position, said second rotation-regulating surface having a center of second curvature at a second position different from said first position;

wherein each of said first and said second curvatures is less than or equal to said zeroth curvature.

2. A swash plate type compressor as claimed in claim 1, further comprising a shoe interposed between each of opposite sides of said swash plate and a given portion of said piston for converting said rotary motion of the swash plate into a reciprocating motion of said piston.

3. A swash plate type compressor as claimed in claim 1, wherein each of said first and said second positions is offset from said first axis.

4. A swash plate type compressor as claimed in claim 1, wherein each of said first and said second axes extending along a predetermined plane, said first rotation-regulating surface and said second position being located at one side of said predetermined plane, said second rotation-regulating surface and said first position being located at another side of said predetermined plane.

5. A swash plate type compressor as claimed in claim 4, wherein said first axis is between said first and said second positions.

6. In a swash plate type compressor having a housing in which a rotary motion of a swash plate is converted into a reciprocating motion of a piston via a shoe interposed between each of the opposite sides of the swash plate and a given portion of the piston, a piston rotation-regulating structure comprising a plurality of rotation-regulating convex curved surfaces provided on said piston so as to face an inner periphery of said housing for limiting a rotation range of said piston to prevent engagement between said piston and a circumference of said swash plate, wherein the centers of curvature of said rotation-regulating convex curved surfaces in a circumferential direction of said piston are located at different positions from each other, and a curvature of each rotation-regulating convex curved surface is less than or equal to a curvature of said inner periphery of said housing.

7. The piston rotation-regulating structure according to claim 6, wherein the curvatures of said rotation-regulating convex curved surfaces are set equal to each other.

8. The piston rotation-regulating structure according to claim 6, wherein said rotation-regulating convex curved surfaces are continuous with each other via an intermediate surface interposed therebetween.

9. The piston rotation-regulating structure according to claim 6, wherein no centers of curvature of said rotation-regulating convex curved surfaces coincide with the center of curvature of the inner periphery of said housing.

10. A swash plate type compressor comprising:

a housing having a first axis and an inner periphery of zeroth curvature around a first axis;

a swash plate rotatable around said first axis; and a piston operatively coupled to said swash plate within said housing and reciprocating in accordance with a rotary motion of said swash plate along a second axis parallel to said first axis, said piston having a first and a second rotation-regulating surface which are angularly offset from one another around said second axis and face said inner periphery, said first rotation-regulating surface having a center of first curvature at a first position, said second rotation-regulating surface having a center of second curvature at a second position different from said first position;

wherein each of said first and second axes extending along a predetermined plane, said first rotation-regulating surface and said second rotation-regulating surface and said first position being located at another side of said predetermined plane.

11. A swash plate type compressor as claimed in claim 10, further comprising a shoe interposed between each of opposite sides of said swash plate and a given portion of said position for converting said rotary motion of the swash plate into a reciprocating motion of said piston.

12. A swash plate type compressor as claimed in claim 10, wherein each of said first and sad second curvatures is equal to or smaller than said zeroth curvature.

13. A swash plate type compressor as claimed in claim 10, wherein each of said first and second positions is offset from said first axis.

14. A swash plate type compressor as claimed in claim 10, wherein said first axis is between said first and second positions.

* * * * *